US005707138A

United States Patent [19]

Pan

[11] Patent Number: 5,707,138

[45] Date of Patent: Jan. 13, 1998

[54] LIGHT BULB HOLDER HAVING DRAINING PASSAGEWAYS

[76] Inventor: Wun Fang Pan, 125, Lane 99, Din Pu Road, Hsinchu, Taiwan

[21] Appl. No.: 773,531

[22] Filed: Dec. 23, 1996

[51] Int. Cl.[6] ..... F21V 25/00

[52] U.S. Cl. ..... 362/226; 362/96; 362/806; 313/318.01

[58] Field of Search ..... 362/96, 226, 249, 362/806; 439/611, 619; 313/318.01

[56] References Cited

U.S. PATENT DOCUMENTS

| | | | |
|---|---|---|---|
| 3,182,185 | 5/1965 | Ahroni et al. | 362/226 |
| 3,335,389 | 8/1967 | Reichardt | 362/249 |
| 4,679,126 | 7/1987 | Van Sickler | 362/226 |
| 4,999,751 | 3/1991 | Chen | 362/226 |
| 5,331,529 | 7/1994 | Huang | 362/226 |
| 5,498,922 | 3/1996 | Chang | 362/249 |
| 5,605,395 | 2/1997 | Peng | 362/226 |

*Primary Examiner*—Alan Cariaso
*Attorney, Agent, or Firm*—Morton J. Rosenberg; David I. Klein; Jun Y. Lee

[57] ABSTRACT

A light bulb holder having draining passageways includes a base connecting with a cap having engaged with a light bulb wherein two channels are formed on the sides of the cap and two grooves are provided in related inner sides of the base. After a connection between the cap and the base, two channels and two grooves become two draining passageways through the light bulb holder that provides infiltrating water pass by very soon and prevent from an electrical short circuit or eroding.

1 Claim, 4 Drawing Sheets

LIGHT BULB HOLDER HAVING DRAINING PASSAGEWAYS

BACKGROUND OF THE INVENTION

Usually, a light string is used outdoor and often subject to rain. It is inevitable to have some water infiltrating into the base. If water stay inside the base, it may erode the conductors resulting is a short circuit. Prior art fastening systems for decorative light bulb holders generally use a tight or force fit between a cap and a base, however, such a connection does not provide for secure coupling and loosening often occurs and can not prevent from water infiltrating. Other designs are providing draining features for infiltrating water to pass by through chinks between the cap and the bulb holder base. In such structures, the effect of draining is obviously poor and the staying water may erode the electrical conductors or occurs a short circuit.

SUMMARY OF THE INVENTION

In view of the above drawback, the primary object of the present invention is to provide an improved cap and base structure which can drain water from the base very soon and prevent from resulting in a short circuit, eliminating the drawback of the said prior systems.

BRIEF DESCRIPTION OF THE ACCOMPANYING DRAWINGS

DETAILED DESCRIPTION OF THE EMBODIMENTS

Figure 1:
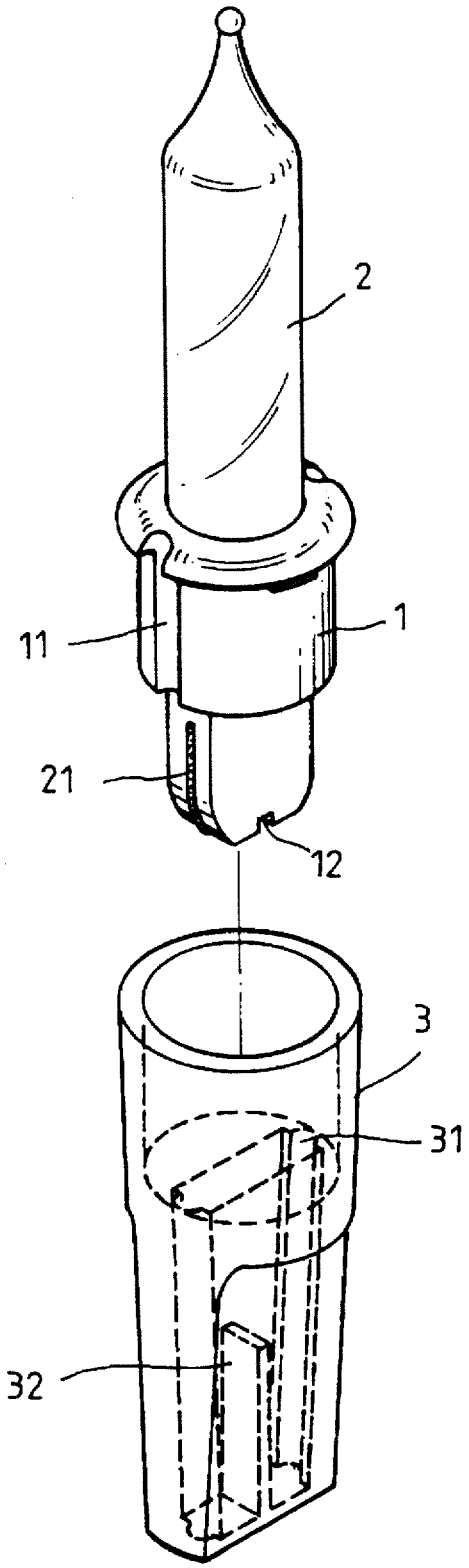
FIG. 1 is an exploded perspective view showing an embodiment of the invention.
Figure 2:
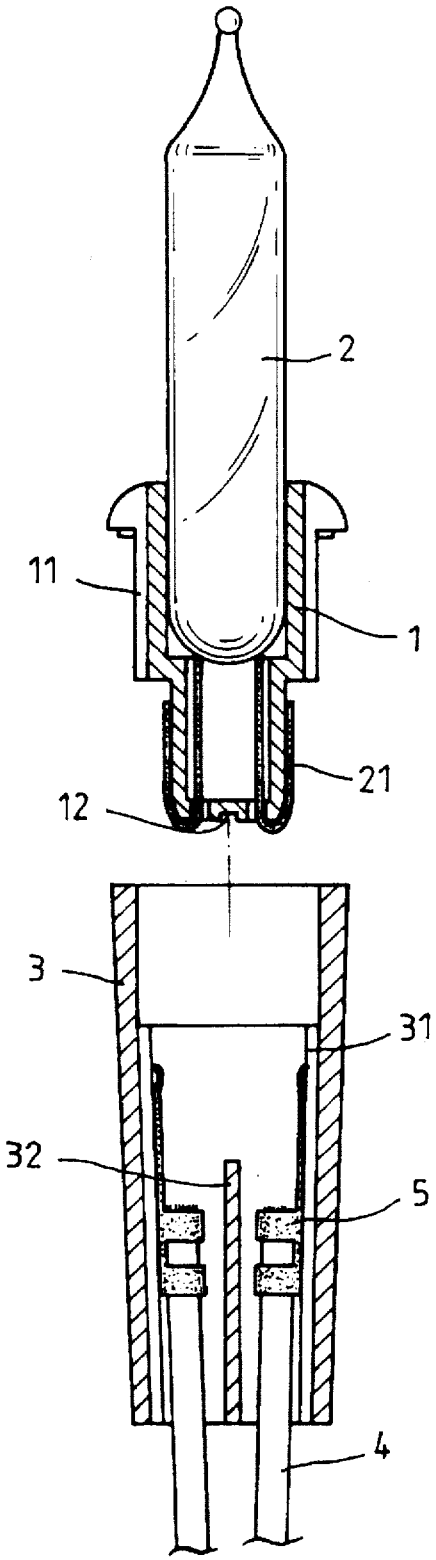
FIG. 2 is a cross sectional plan view of FIG. 1.
Figure 3:
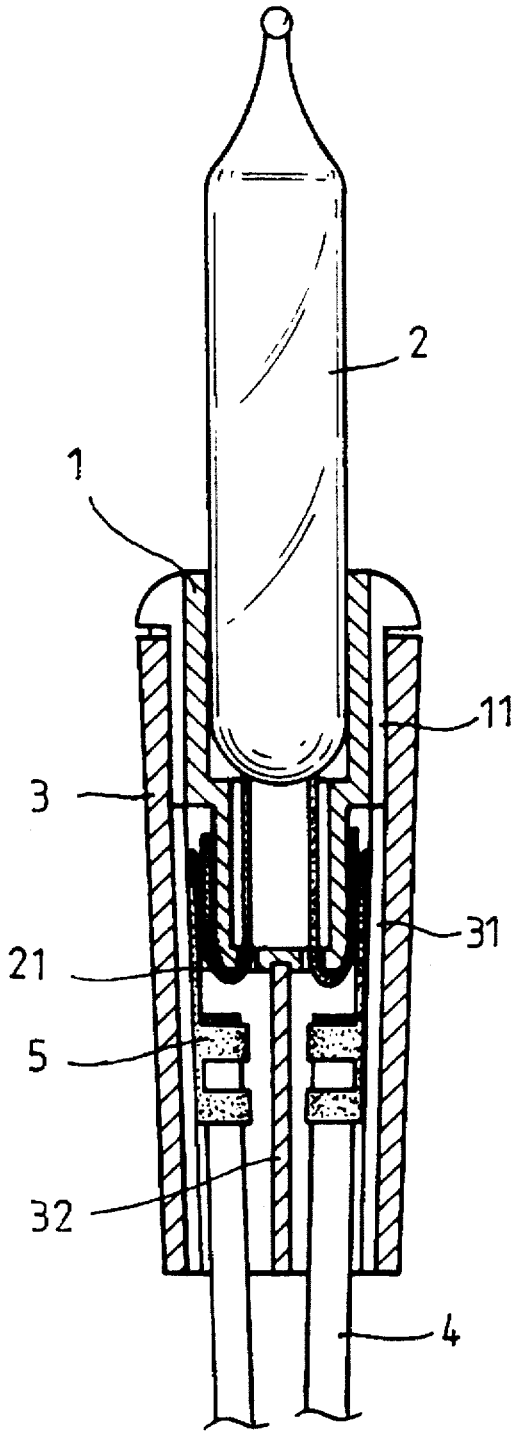
FIG. 3 is an assembled view of the embodiment of FIG. 2.

Referring to FIGS. 1 to 3, there are shown the light bulb holder including a cap (1) receiving a light bulb (2) which is connected to an upper hole of the base (3) to become a light bulb set as a prior known structure. The primary characteristic of the invention is that there are two draining channels (11) provided in both sides of the cap (1) and there are two draining grooves (31 ) provided in related inner sides of the base (3). When the cap (1) with the light bulb (2) is connected to the base (3), two draining channels (11) of the cap (1) and two draining grooves (31 ) become two passageways through the light bulb holder. Moreover, a slot (12) is provided on the bottom of the cap (1) and a plate (32) is formed in the base (3). After connection of the cap (1) and the base (3), the end of the plate (32) will be engaged within the slot (12), that divides the inner space of the base (3) into two separated parts. Two electrical wires (4) connecting with related conductors (5) are inserted into the two separated parts in the base (3) and contacted with two conducting wires (21) of the light bulb (2). Because both conductors (5) and the related conducting wires (21 ) are set in the two separated parts in the base, it will never occur an electrical short circuit.

Figure 4:
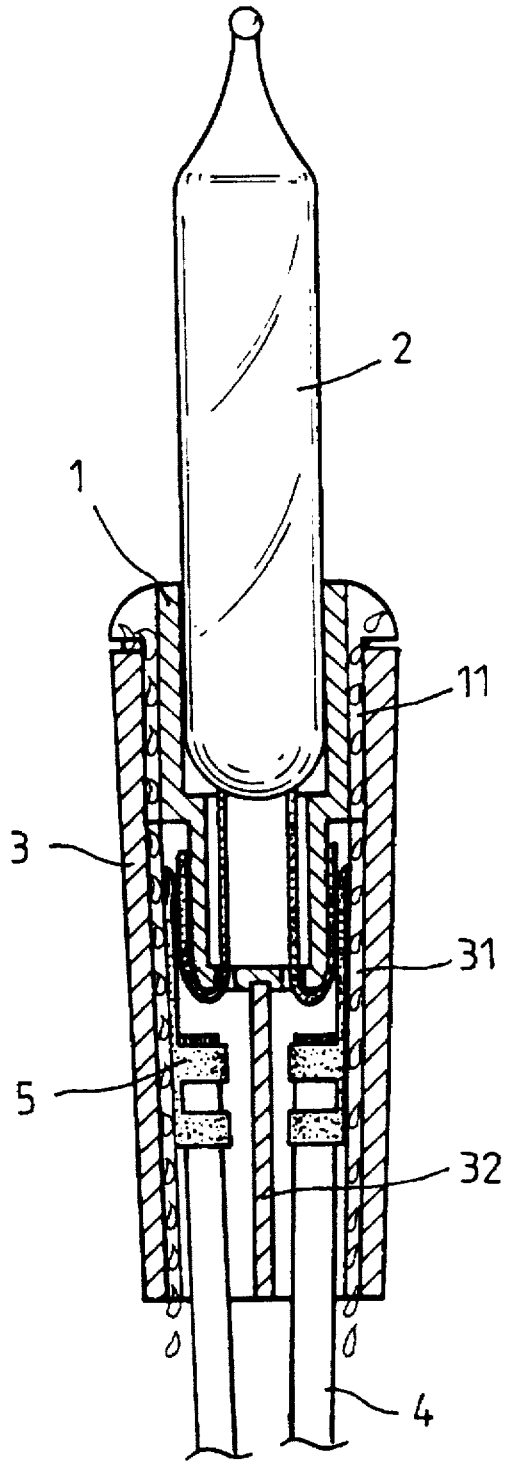
FIG. 4 is an exemplification of the invention as in FIG. 3.

As shown in FIG. 4, when rain water is infiltrated into the light bulb holder, it can quickly pass by through the passageways consisted of draining channels (11) and draining grooves (31) and will not stay therein that can prevent from eroding or electric leakage. However, since two different poles of electricity on the conductors and conducting wires are set in the separated parts in the base, it means that the infiltrating water will never touch different electrical poles at the same time and a shout circuit because of the ram is absolutely prevented.

I claim:

1. A light bulb holder having draining passageways including a light bulb having its one end inserting into a cap and the cap as well as the light bulb being put into an inner space of a base; characterized in that two draining channels are formed on two sides of the cap and a slot is formed on an bottom of the cap; two draining grooves are provided in related inner sides of the base and a plate is provided in the base, and when the cap with the bulb is connected to the base, the two draining channels and the two draining grooves are aligned to become two passageways through the light bulb holder for draining infiltrating water quickly and an end of the plate is engaged within the slot that divides the inner space of the base into two separated parts for avoiding infiltrating water contacting different electrical poles on conductors and conducting wires at the same time and prevent an electrical leakage or short circuit.

* * * * *